United States Patent [19]

Beck et al.

[11] Patent Number: 4,846,653

[45] Date of Patent: Jul. 11, 1989

[54] PACK OF SPINNING NOZZLES FOR FORMING TWO COMPONENT FILAMENTS HAVING CORE-AND-SHEATH STRUCTURE

[75] Inventors: Arnold Beck; Dieter Ahrendt, both of Neumuenster, Fed. Rep. of Germany

[73] Assignee: Neumünstersche Maschinen - und Apparatebau GmbH (Neumag), Neumünster, Fed. Rep. of Germany

[21] Appl. No.: 159,835

[22] Filed: Feb. 24, 1988

[30] Foreign Application Priority Data

Apr. 1, 1987 [DE] Fed. Rep. of Germany ..... 3710946

[51] Int. Cl.[4] ..... B29C 47/00

[52] U.S. Cl. ..... 425/131.5; 264/171

[58] Field of Search ..... 264/171; 425/131.5, 425/462

[56] References Cited

U.S. PATENT DOCUMENTS

| | | | |
|---|---|---|---|
| 3,121,254 | 2/1964 | Heymen et al. | 425/131.5 |
| 3,531,368 | 9/1970 | Okamoto et al. | 264/171 |
| 3,540,080 | 11/1970 | Goosens | 425/131.5 |
| 3,559,327 | 2/1971 | Biggelar et al. | 264/171 |
| 3,807,917 | 4/1974 | Shimoda et al. | 264/171 |
| 3,807,918 | 4/1974 | Chill et al. | 425/462 |
| 4,128,386 | 12/1978 | Wissinger et al. | 425/462 |
| 4,406,850 | 9/1983 | Hills | 264/171 |
| 4,717,325 | 1/1988 | Fujimura et al. | 425/131.5 |

FOREIGN PATENT DOCUMENTS

| | | |
|---|---|---|
| 0128013 | 12/1984 | European Pat. Off. . |
| 1435559 | 2/1970 | Fed. Rep. of Germany . |
| 2004431 | 8/1971 | Fed. Rep. of Germany . |
| 1660702 | 3/1972 | Fed. Rep. of Germany . |

*Primary Examiner*—Jay H. Woo
*Assistant Examiner*—Mathieu Vargot
*Attorney, Agent, or Firm*—Michael J. Striker

[57] ABSTRACT

The package of spinning nozzles is assembled of a nozzle plate, an intermediate plate and a cover plate. The upper side of the nozzle plate is provided with a plurality of parallel grooves each having a bottom wall formed with a series of spinning nozzles. The lower side of the intermediate plate is formed with a plurality of lamellae projecting into the corresponding grooves of the nozzle plate. Each lamella has a series of through-bores which are aligned with respective spinning nozzles. The intermediate plate is formed with a transverse main distributing channel which communicates at opposite sides thereof with distributing branch channels extending between the lamellae and being delimited by the upper side of the nozzle plate. The distributing branch channels communicate with respective spinning nozzles via curved recesses formed in the lateral walls of the grooves. The bottom side of the cover plate is formed with a dome-shaped recess enclosing the inlets of the through-bores in the intermediate plate. The recess is provided with an inlet for the core component of the extruded filaments and with another inlet for receiving a tubular conduit communicating with the transverse main distributing channel to supply the sheath component therein.

5 Claims, 4 Drawing Sheets

PACK OF SPINNING NOZZLES FOR FORMING TWO COMPONENT FILAMENTS HAVING CORE-AND-SHEATH STRUCTURE

BACKGROUND OF THE INVENTION

The present invention relates to an assembly of spinning nozzles for forming composite filaments having a core-and-sheath structure, including a nozzle plate provided with a plurality of spinning nozzles, a cover plate enclosing with the nozzle plate at least one cavity, an intermediate plate sandwiched between the nozzle and cover plates to divide the cavity into two chambers, the intermediate plate being formed with a plurality of bores arranged in alignment with respective nozzles, at least one inlet conduit communicating with a chamber between the cover plate and the intermediate plate to feed a core component therein, and at least one inlet conduit communicating with the chamber between the intermediate plate and the nozzle plate to feed a sheath component therein.

Synthetic two-component fibers or filaments having a core-and-sheath structure are manufactured in order to unite advantageous properties of different components. For example, it is possible to use as a core component a polymer of a high strength and minute expansion, and as the sheath another polymer which imparts to the filament a good dyeability or a pleasing touch. For many applications a definite filament structure is required wherein the sheath coaxially surrounds the core with a uniform thickness. This requirement can be readily fulfilled with a complex arrangement of spinning nozzles. However, in the mass production it is necessary to install large number of suitable spinning nozzles in a most restricted installation space. This requirement brings about considerable technological problems.

The German publication DE-OS No. 20 04 431 describes a pack of spinning nozzles whose nozzle plate is provided with six nozzles arranged in the corners of a regular hexagon. The intermediate plate is provided with six tubular inserts which project into the conical part of the intake funnel of respective nozzles. The axial bores of the tubular inserts are substantially in alignment with the nozzles to feed core components therein. The intermediate plate has an axial feed conduit communicating via a channel system with the inlet funnels of the nozzles to feed the sheath component therein. This prior art nozzle assembly due to its structural design is limited to a very small number of spinning nozzles which are spaced apart from one another at a relatively large distance.

The same disadvantages has a spinning nozzle assembly described in the German publication DE-OS No. 16 60 702.

Known is also from the German publication DE-OS No. 14 35 559 a spinning nozzle assembly for the production of two component filaments wherein the nozzle plate and the intermediate plate are made of relatively thin metal sheets and arranged at a minute distance one from the other. The spinning nozzles have a very large number of simple bores which are arranged closely one to each other. The interspace between the two plates communicates via bores which are distributed on the circumference of the assembly with an annular distributing channel surrounding the plate to form an inlet for one of the two components. Consequently, this component forms between the two plates a layer flowing in radial direction toward the center axis of the plates and being penetrated by thin axial streams of the other component. With this prior art pack of spinning nozzles no well-defined core-and-sheath structure of the filaments can be produced inasmuch as the interface of the two components in respective filaments is non-uniform and irregular.

Another spinning nozzle assembly having a large number of spinning nozzles arranged closely one to each other is disclosed in the European Pat. No. EP-A2-0 128 013. In this pack of spinning nozzles two separate, interleaved channel systems each consisting of a plurality of grooves, are provided on the upper surface of the intermediate plate. Each of the grooves has on its bottom a series of throughbores so that a system of throughbores is assigned to a corresponding channel system. The throughbores of one channel system are aligned with the spinning nozzles and serve for feeding the core component. The throughbores of the other channel system are arranged such that each throughbore of the first channel system is surrounded by a plurality of throughbores of the other channel system. A third plate provided with bores serves for connecting one of the channel systems of the intermediate plate with a supply chamber 4 for the core component and the other channel system with a supply chamber for the sheath component. It is true that in this prior art spinning nozzle assembly the inflow conditions for all nozzles are the same, nevertheless the particular feeding of the sheath component does not guarantee any exact concentric structure of the excluded filament. Moreover, the structural height of the nozzle assembly due to the additional third plate is relatively large.

SUMMARY OF THE INVENTION

It is therefore a general object of the present invention to overcome the disadvantages of prior art spinning nozzle assemblies.

In particular, it is an object of the invention to provide a spinning nozzle pack of the aforedescribed kind which makes it possible to produce simultaneously a very large number of two component filaments each having a uniform coaxial structure.

Another object of this invention is to provide such an improved pack which can be installed in an extremely narrow space and has a very small installation height.

Still another object of this invention is to provide such an improved spinning nozzle pack which is simple to manufacture.

In keeping with these objects and others which will become apparent hereafter, one feature of this invention resides in the provision of a nozzle plate formed on its upper surface with a plurality of parallel grooves whereby series of spinning nozzles are provided in the bottom wall of each of the grooves, the intermediate plate has on its lower side a plurality of lamellae projecting down to the bottom wall of respective grooves in the nozzle plate, each of the lamellae having a series of throughbores which are in axial alignment with assigned spinning nozzles in the nozzle plate and which communicate with a supply chamber in the cover plate for feeding in the core component, a plurality of distributing branch channels provided between respective lamellae and each communicating via a recess in lateral walls of respective grooves in the nozzle plate with intake funnels of the spinning nozzles, and the distributing branch channels communicating with a distributing central channel for feeding in the sheath component.

Consequently, in the pack of spinning nozzles according to the invention both of the polymer components are kept separately in the interspace between the nozzle plate and the intermediate plate and are fed in exactly guided, separate streams into respective nozzles. This advantage which hitherto has been achieved only in singular spinning nozzles or in complicated arrangements of a limited number of spinning nozzles, is due to the invention achievable for assemblies having many hundreds or even several thousands of spinning nozzles arranged in an extremely narrow space. The entire pack of spinning nozzles consists of a small number of components which can be readily produced by milling or drilling processes.

In the preferred embodiment of the invention, the recesses in the lateral walls of the grooves in the nozzle plate have the configuration of cylindrical segments so that the manufacture thereof is greatly simplified.

In another modification the distributing branch channels are arranged at opposite sides of the distributing main channel so that the branch channels are relatively short and consequently pressure drop of the supplied component is reduced.

Preferably, the height of the distributing branch channels decreases proportionally to the distance from the distributing main channel so that the flow of the sheath material is kept uniform.

In another preferred embodiment the spinning nozzles and the corresponding feed in throughbores and branch channels are divided into two equal, functionally separate systems. In this manner, the entire spinning nozzle assembly can occupy a large area without excessively enlarging the horizontal path of flow of the components.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
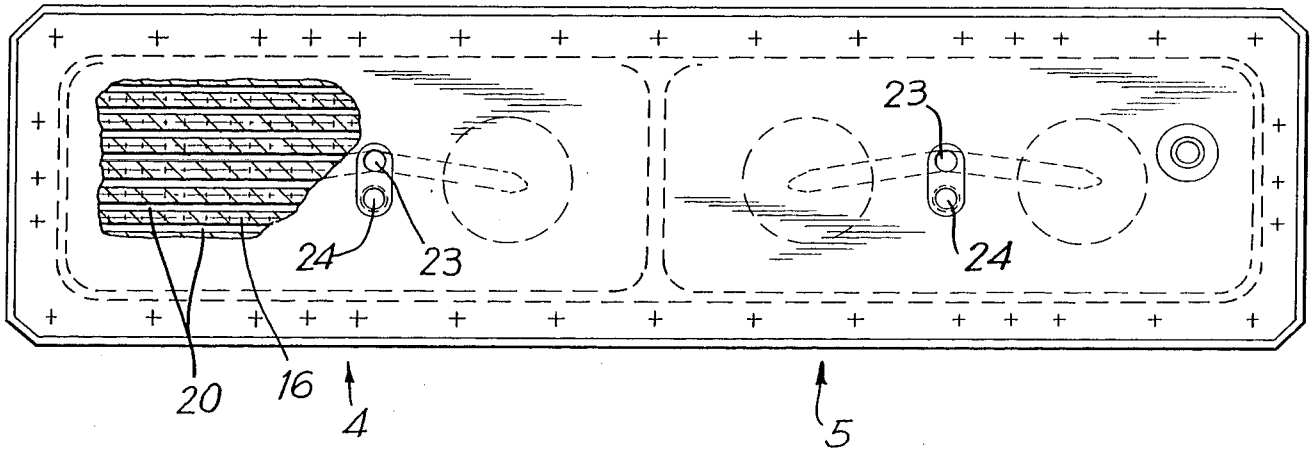
FIG. 1 is a plan view of an embodiment of the spinning nozzle assembly of this invention, shown with a cutaway top part.
Figure 2:
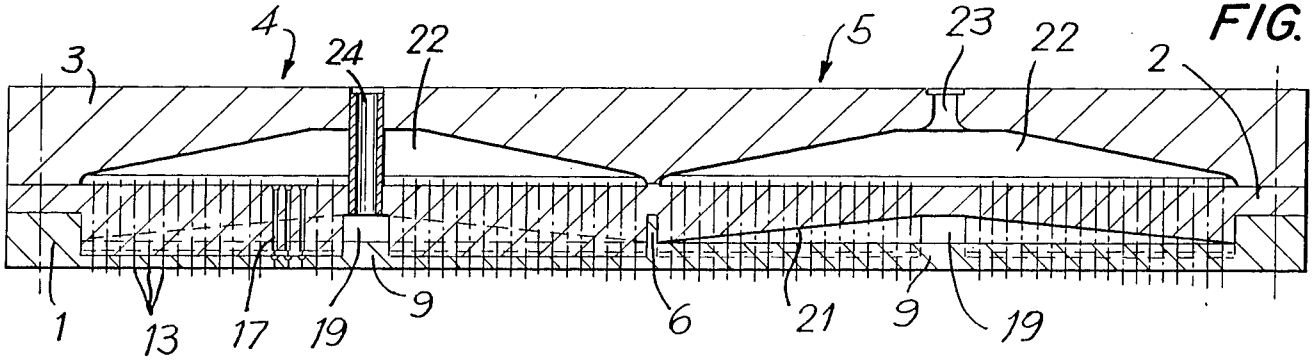
FIG. 2 shows longitudinal side section of the assembly of FIG. 1 whereby the right half is taken in a different sectional plane than the left half.

Referring firstly to FIGS. 1 and 2, the assembly of spinning nozzles consists of three superposed parts, namely of a nozzle plate 1, an intermediate plate 2 and a cover plate 3, which are firmly connected one to each other by means of screws, for example. In the plan view the nozzle pack has a rectangular contour whose length is about four times as large as its breadth. The nozzle pack includes two functionally separate systems 4 and 5. The two systems are identical and therefore only one of them will be described in detail.

Figure 4:
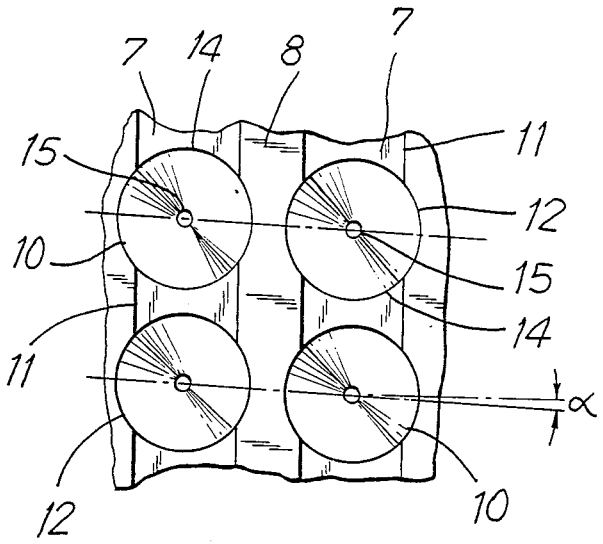
FIG. 4 is a plan view of a portion of the nozzle plate in the assembly of FIG. 1, shown on a considerably enlarged scale.
Figure 5:
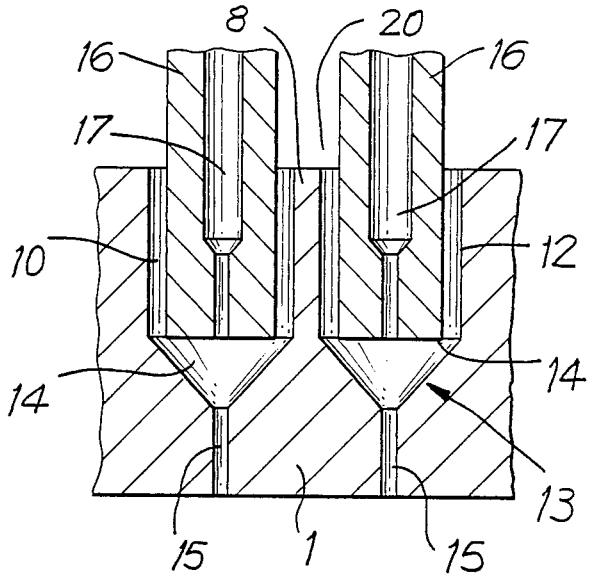
FIG. 5 shows on an enlarged scale a detail of FIG. 3.
Figure 6:
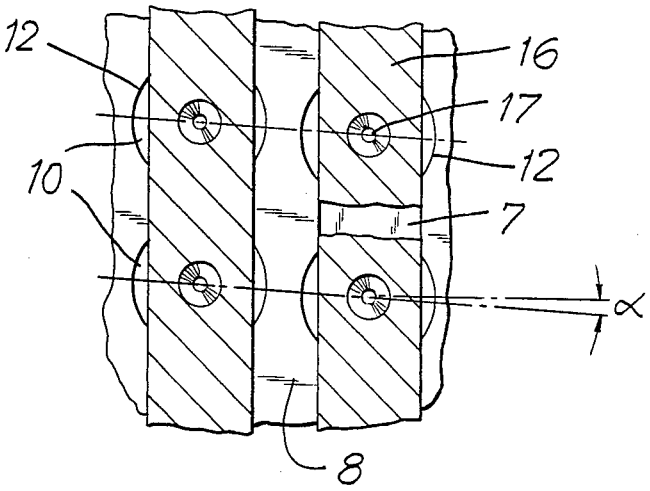
FIG. 6 is a plan view of a horizontal section of the part of FIG. 5.

The nozzle plate 1 has the configuration of a rectangular flat tray formed with an elevated rim. At the center of its longitudinal sides, the nozzle plate 1 is formed with a narrow partition 6 of the same height as the rim. The partition 6 divides the recessed part of the nozzle plate 1 into two compartments of which one pertains to the operational system 4 and the other to the system 5. The bottom surface of each compartment is provided with longitudinal parallel grooves 7 separated one from the other by narrow webs 8 shown in FIGS. 4–6. At the center of each compartment, the grooves 7 are interrupted by a transverse, broad threshold 9 whose height corresponds to that of the webs 8. Lateral walls of each groove 7 are formed with opposite, mirror-symmetrically curved recesses 10 delimited by facing cylindrical wall segments 12 spaced from each other at regular intervals. Accordingly, the lateral walls of respective grooves 7 consist of alternating pairs of flat or straight wall segments 11 and cylindrical wall segments 12. The bottom of each groove is formed with a series of spinning nozzles 13 whose center axes coincide with the center of curvature of corresponding cylindrical wall segments 12 and recesses 10 in the lateral walls. Each spinning nozzle 13 includes an intake funnel 14 whose inlet opening a radius corresponding to the radius of curvature of the cylindrical wall segments 12. The outlet opening of each intake funnel 14 communicates with a capillary outlet bore or spinneret 15. The series of spinning nozzles 13 together with the corresponding recesses 10 in adjacent spinneret grooves 7 are staggered relative to each other that means their center axes in a plan view pass through the corners of an oblique angled grid; it will be seen from FIGS. 4 and 6, the transverse coordinates deviate by a sharp angle from a vertical to the longitudinal coordinates.

Figure 3:
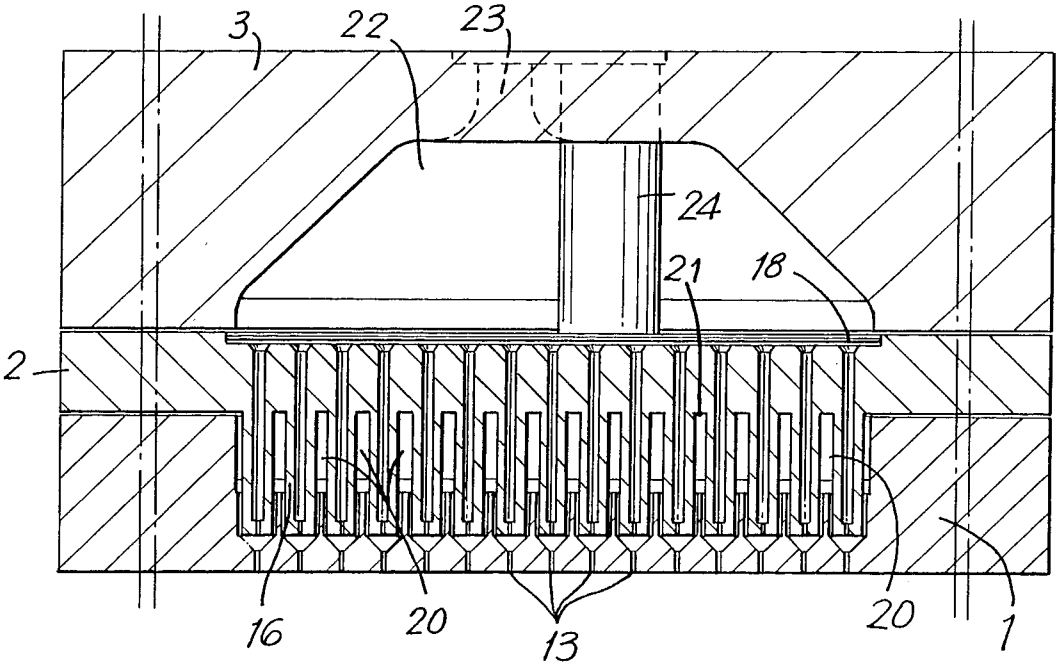
FIG. 3 is a transverse side section of the assembly of FIG. 1 shown on an enlarged scale.

The intermediate plate 2 has a lower side which is formed with longitudinal lamellae 16 projecting into respective grooves 7 of the nozzle plate 1 to the level of the bottom wall of the grooves. The breadth of each lamella is essentially equal to the clearance between the flat sectors 11 of the lateral walls of the grooves 7 so that the lamellae 16 engage the flat sectors 11 without any noticeable play. In cross-section, as it will be best seen in FIG. 3, the intermediate plate 2 has a comb-like contour. Each lamella 16 is provided with a series of perpendicular throughbores 17 which in the assembled condition of the pack are in axial alignment with corresponding spinning nozzles 13. It will be seen from FIG. 5 the greatest part of the length of the throughbores 17 has a diameter which is substantially larger than that of the capillary spinnerets 15. Only a short lower end piece of the throughbores 17 is reduced in diameter to match the clearance of the spinnerets. The upper end of each throughbore 17 transits into a short intake funnel (FIG. 3). A filtering screen 18 covers the region of the upper surface of the intermediate plate 2 which is formed with the intake funnels of the throughbores 17.

Above the threshold 9, the lamellae 16 are interrupted by transversely directed, distributing main channel 19 whose width corresponds to the width of the threshold 9. Transverse main distributing channel 19 communicates with a plurality of branch distributing channels 20 delimited by the rectangular spaces between respective lamellae 16 and the upper sides of the webs 8. The top sides 21 of the channels 20 slope downwardly in the direction from the main distributing channel 19 toward the rim or toward the central partition 6. As it will be explained in greater detail later on, the branch channels 20 open into the distributing main channel 19 which in turn communicates with an inlet pipe for a component material of the filament.

The cover plate 3 consists of a thick metal plate provided on its lower side with two dome-shaped chambers 22 each facing a compartment in respective operating systems 4 or 5. Each chamber 22 communicates via an inlet passage 23 with the upper side of the cover plate. Besides the passage 23 there is provided another passage for receiving a pipe 24 which extends through the chamber 22, the intermediate plate 2 and opens into the upper side of the distributing main channel 19.

In operation, a non-illustrated pump delivers the core component into the passage 23 to fill up the chamber 22. From the chamber 22, the core component is forced through the filtering sieve 18 into the throughbores 17 from which it is extruded in the form of filament-like streams into respective nozzles. Since the major part of the length of the throughbores 17 has a relatively large diameter, the flow resistance is relatively low. The sheath component is also forced by a non-illustrated delivery pump through the inlet pipe 24 into the distributing main channel 19 wherefrom it is pressed into the distributing branch channels 20 at both opposite sides of the main channel 19. The recesses 10 delimited by facing cylindrical wall segments 12 in the grooves 7 from passages through which the flow of the sheath component is diverted vertically downwardly against the inlet funnels 14 of the spinning nozzles 13. In the region of the inlet funnels, the stream of the sheath component surrounds the filament-like stream of the core component exiting from the throughbores 17. Due the injection effect of the filament-like stream, a thin, coaxial layer of the sheath component is entrained on the surface of the core component and the resulting two component filaments extruded from respective spinning nozzles are cooled in conventional manner by an air stream; by the staggered arrangement of the nozzles 13, mutual sheltering of the individual filaments from the cooling air stream is prevented.

While the invention has been illustrated and described as embodied in a specific example of the spinning nozzle assembly, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A spinning nozzle assembly for producing two component filaments having a core-and-sheath structure, comprising a nozzle plate, an intermediate plate, and a cover plate, the upper side of the nozzle plate which engages the intermediate plate being provided with a plurality of parallel grooves each defining opposite lateral sides and a bottom side, the bottom sides of the grooves being formed with a series of spinning nozzles, each spinning nozzle having a funnel-shaped inlet portion opening into said bottom side and a capillary spinneret opening into the lower side of the nozzle plate, the opposite lateral walls of said grooves being provided in the region of respective nozzles with curved recesses, the bottom side of said intermediate plate being formed with a plurality of parallel lamellae each projecting into an assigned groove in the nozzle plate, each of the lamellae having a series of throughbores extending between the upper and lower sides of the intermediate plate and each opening into the funnel-shaped part of a spinning nozzle, a main distributing channel extending transversely to said grooves and communicating with a plurality of distributing branch channels formed between respective lamellae and the upper side of said nozzle plate, said distributing branch channels communicating with said curved recesses in the lateral walls of said grooves with the funnel-shaped inlet parts of respective spinning nozzles, said cover plate being formed on its lower side with a recess enclosing the region of the upper side of said intermediate plate which is formed with said throughbores, said recess having an inlet passage for the core component, and another inlet passage for receiving a tubular conduit communicating with said transverse main distributing channel in said intermediate plate to feed the sheath component therein.

2. A spinning nozzle assembly as defined in claim 1, wherein the curved recesses in the lateral walls of the grooves in said nozzle plate have the configuration of cylindrical segments alternating with flat segments of the lateral walls.

3. A spinning nozzle assembly as defined in claim 2, wherein said distributing branch channels communicate with two opposite sides of said main distributing channel.

4. A spinning nozzle assembly as defined in claim 3, wherein the height of said distributing branch channels decreases in the direction away from said main distributing channel.

5. Large area spinning nozzle assembly comprising at least two identical spinning nozzle assemblies according to claim 1 which are integrally connected side by side and functionally separated from one another.

* * * * *